US009240638B2

(12) United States Patent
Peloza

(10) Patent No.: US 9,240,638 B2
(45) Date of Patent: Jan. 19, 2016

(54) MEZZANINE CONNECTOR WITH TERMINAL BRICK

(75) Inventor: Kirk B. Peloza, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/005,604

(22) PCT Filed: Mar. 16, 2012

(86) PCT No.: PCT/US2012/029471

§ 371 (c)(1),
(2), (4) Date: Sep. 17, 2013

(87) PCT Pub. No.: WO2012/125938

PCT Pub. Date: Sep. 20, 2012

(65) Prior Publication Data

US 2014/0017950 A1 Jan. 16, 2014

Related U.S. Application Data

(60) Provisional application No. 61/453,847, filed on Mar. 17, 2011.

(51) Int. Cl.

| | |
|---|---|
| ***H01R 12/71*** | (2011.01) |
| ***H01R 12/52*** | (2011.01) |
| ***H01R 12/73*** | (2011.01) |
| ***H01R 13/6585*** | (2011.01) |
| ***H01R 13/6471*** | (2011.01) |
| *H01R 13/6473* | (2011.01) |

(52) U.S. Cl.

CPC ..... *H01R 12/52* (2013.01); *H01R 12/73* (2013.01); *H01R 13/6471* (2013.01); *H01R 13/6585* (2013.01); *H01R 13/6473* (2013.01)

(58) Field of Classification Search

CPC .. H01R 12/71; H01R 13/6581; H01R 9/2408; H01R 12/7082; H01R 12/73

USPC ..... 439/74

See application file for complete search history.

(56) References Cited

U.S. PATENT DOCUMENTS

| | | | |
|---|---|---|---|
| 6,116,926 | A | 9/2000 | Ortega et al. |
| 6,174,202 | B1 | 1/2001 | Mitra |
| 6,461,202 | B2 | 10/2002 | Kline |
| 6,702,590 | B2 | 3/2004 | Zaderej et al. |
| 6,764,341 | B2 | 7/2004 | Lappoehn |
| 6,869,292 | B2 | 3/2005 | Johnescu et al. |

(Continued)

FOREIGN PATENT DOCUMENTS

| | | |
|---|---|---|
| JP | 2001-196126 | 7/2001 |
| JP | 2002-151207 | 5/2002 |

(Continued)

OTHER PUBLICATIONS

International Search Report for PCT/US2012/029471.

*Primary Examiner* — Truc Nguyen
(74) *Attorney, Agent, or Firm* — Stephen L. Sheldon

(57) ABSTRACT

A connector is provided that includes a first housing that supports first terminal bricks. The first housing can mate with a second housing that supports second terminal bricks that are configured to make with the first terminal bricks. The first housing and first terminal bricks can be adjusted so that a variety of spacing requirements can be met by the combination of the first and second housings while allowing for reduced tooling investment.

14 Claims, 18 Drawing Sheets

(56) References Cited

U.S. PATENT DOCUMENTS

| | | | |
|---|---|---|---|
| 6,899,566 | B2 | 5/2005 | Kline et al. |
| 6,971,916 | B2 | 12/2005 | Tokunaga |
| 6,979,226 | B2 | 12/2005 | Otsu et al. |
| 7,048,585 | B2 | 5/2006 | Milbrand, Jr. et al. |
| 7,094,102 | B2 | 8/2006 | Cohen et al. |
| 7,101,224 | B2 | 9/2006 | Dattilo et al. |
| 7,108,556 | B2 | 9/2006 | Cohen et al. |
| 7,278,886 | B2 | 10/2007 | Cohen et al. |
| 7,331,830 | B2 | 2/2008 | Minich |
| 7,344,391 | B2 | 3/2008 | Minich |
| 7,381,092 | B2 | 6/2008 | Nakada |
| 7,416,447 | B1 | 8/2008 | Chen |
| 7,422,444 | B1 | 9/2008 | Johnescu |
| 7,422,484 | B2 | 9/2008 | Cohen et al. |
| 7,425,137 | B1 | 9/2008 | Sipe et al. |
| 7,485,001 | B2 | 2/2009 | Chen et al. |
| 7,513,797 | B2 | 4/2009 | Scherer et al. |
| 7,530,846 | B1 | 5/2009 | Chen |
| 7,544,096 | B2 | 6/2009 | Cohen et al. |
| 7,553,187 | B2 | 6/2009 | Feldman et al. |
| 7,575,482 | B1 | 8/2009 | Pepe et al. |
| 7,604,502 | B2 | 10/2009 | Pan |
| 7,651,337 | B2 | 1/2010 | McNamara |
| 7,722,399 | B2 | 5/2010 | Scherer et al. |
| 7,762,847 | B2 | 7/2010 | Feldman et al. |
| 7,771,233 | B2 | 8/2010 | Gailus |
| 7,931,481 | B2 | 4/2011 | Yamakami |
| 7,988,491 | B2 | 8/2011 | Davis et al. |
| 2008/0220630 | A1 | 9/2008 | Sipe et al. |
| 2010/0144169 | A1 | 6/2010 | Glover et al. |
| 2011/0143591 | A1* | 6/2011 | Davis et al. ..... 439/607.27 |
| 2011/0250779 | A1* | 10/2011 | Howard et al. ..... 439/346 |
| 2012/0202363 | A1* | 8/2012 | McNamara et al. ..... 439/74 |
| 2012/0252232 | A1* | 10/2012 | Buck et al. ..... 439/55 |
| 2013/0084748 | A1 | 4/2013 | Zaderej et al. |
| 2013/0149898 | A1* | 6/2013 | Schroll et al. ..... 439/607.01 |
| 2014/0242844 | A1* | 8/2014 | Wanha et al. ..... 439/626 |

FOREIGN PATENT DOCUMENTS

| | | |
|---|---|---|
| JP | 2003-257559 | 9/2003 |
| WO | WO 2010/005758 A2 | 1/2010 |

* cited by examiner

D1

MEZZANINE CONNECTOR WITH TERMINAL BRICK

RELATED APPLICATIONS

This application is a national phase of PCT Application No. PCT/US12/29471, filed Mar. 16, 2012, which in turn claims priority to U.S. Provisional Application No. 61/453,847, filed Mar. 17, 2011, and which is incorporated herein by reference in its entirety.

FIELD OF THE INVENTION

The present invention relates to field of connectors, more specifically to connectors suitable to support high-data rate applications.

DESCRIPTION OF RELATED ART

Electrical connectors come in a variety of configurations and generally configured to provide a right-angle or a vertical orientation with respect to the circuit board on which they are mounted. When two circuit boards are provided in a parallel orientation and two appropriately configured connectors are designed to allow the two circuit boards to be mated together with a vertical movement, the connectors are sometimes referred to as a mezzanine style connectors. While a number of mezzanine style connectors exist, one issue that continues to be problematic for such designs is the desire for increased density (e.g., a desire to increase the number of pins per square inch). It is often challenging to provide a dense connector that also performs well at higher frequencies because details that can be safely ignored at 1 GHz, for example, can become significant barriers as the frequency increases beyond 10 GHz. Consequentially, certain individuals would appreciate further improvements in mezzanine style connectors.

BRIEF SUMMARY

A housing is provided with a mating face and a mount face. Channels extend between the two faces. Terminal bricks are inserted in the channels in a first direction and each terminal brick can include a ground terminal and a pair of signal terminals. In an embodiment, the signal terminals can be provided in a pod that is mounted by translating the pod in a second direction so that the pod engages the ground terminal, which may be U-shaped.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
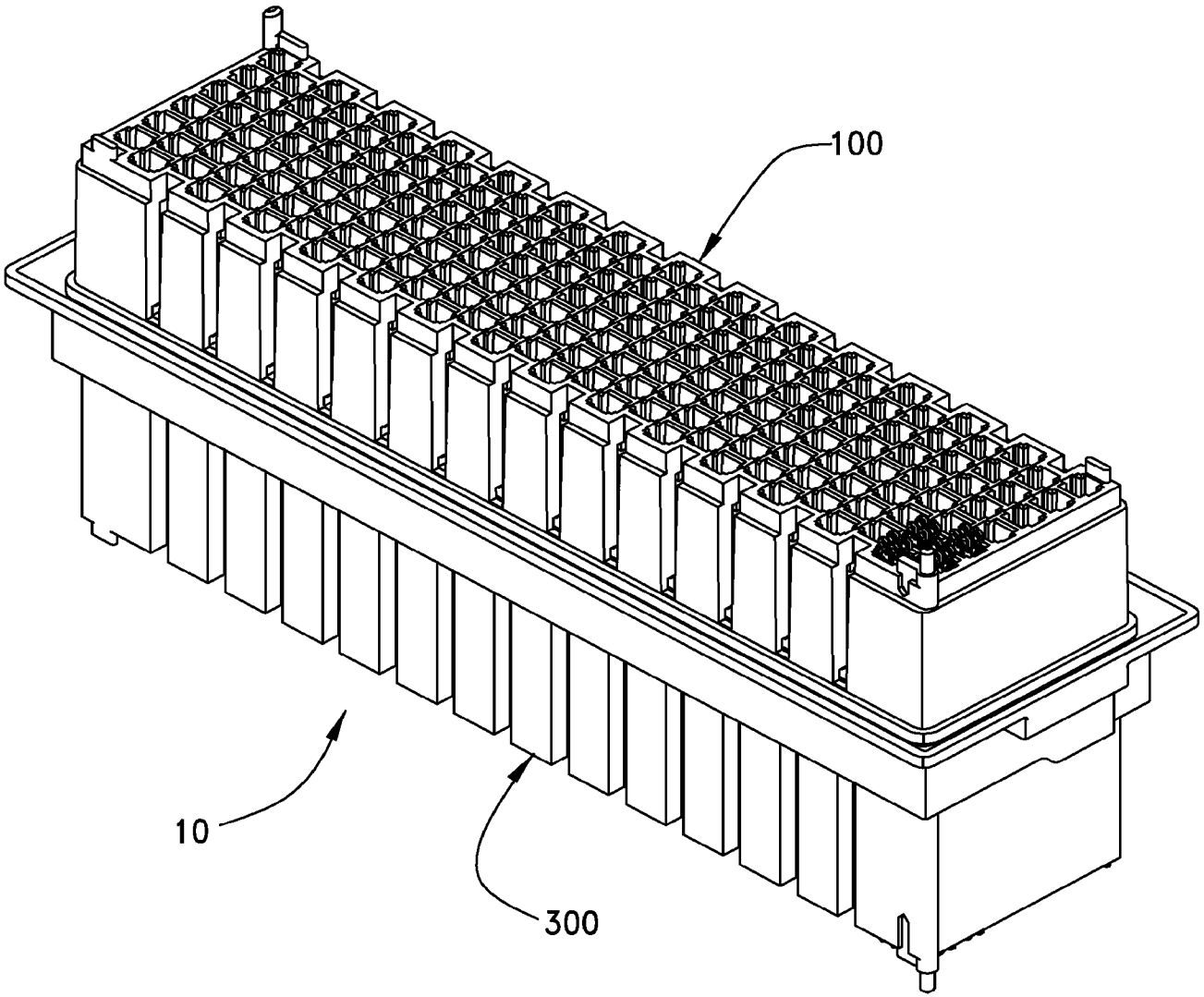
FIG. 1 illustrates a perspective view of an embodiment of a connector system.

Applicants have determined that one issue with existing design is the problem with making mezzanine connectors of different heights. Different applications may require different spacing between connected circuit boards. For example, FIG. 1 illustrates a connector system 10 that includes a first connector 100 that mates to a second connector 300 to provide a mezzanine-style board to board connection. As can be appreciated, different applications might have different spacing requirements and might also have different requirements for the number of terminals supported by the connectors (and/or various footprints such as rectangular and square). In the past this tended to require a large amount of expensive tooling to address all the different dimensional requirements.

Applicants have determined that one solution to this issue is to provide a housing 110 with a first section 120 and a second section 130 that are formed as two pieces and then joined together. As the first section 120 has a first floor 121 with a plurality of aperture 122 in a floor 121 that can each received a terminal brick 150 and the second section 130 has a second floor 131 with apertures 132 that can each receive the terminal brick 150, the two floors 121, 131 can support the terminal bricks 150 in the desired position and orientation. Thus, it is possible to adjust a length 168 of the terminal brick 150 and to adjust a height 128 of a wall 126 of the first section 120 so as to provide a housing 110 with a desired distance between a mounting face 110*a* and a mating face 110*b*. It should be noted, however, that while a two housing structure is believed to provide a lower cost design it is not required to take advantage of other features disclosed herein.

Figure 2:
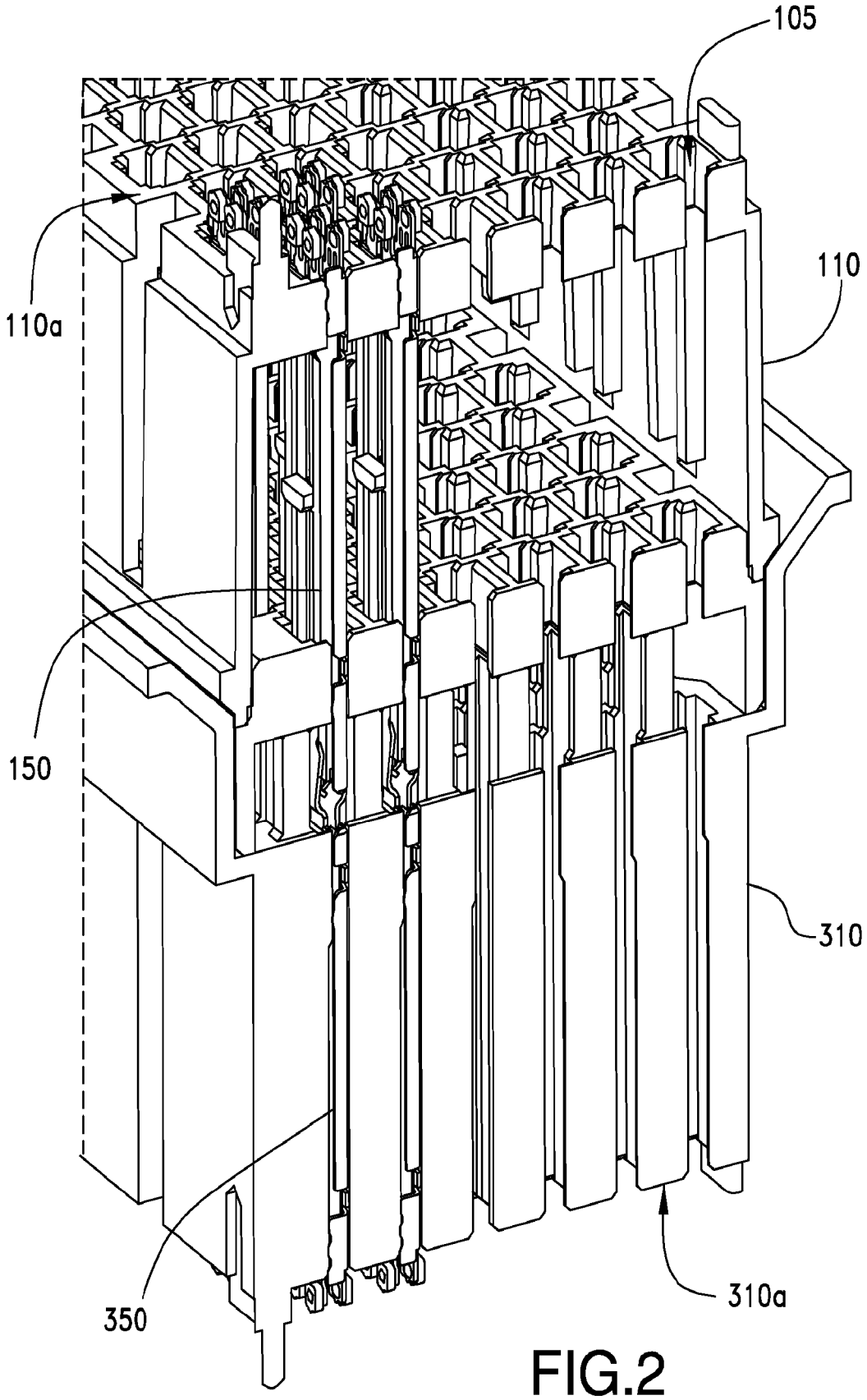
FIG. 2 illustrates a perspective view of a cross-section of an embodiment of a connector system.
Figure 3:
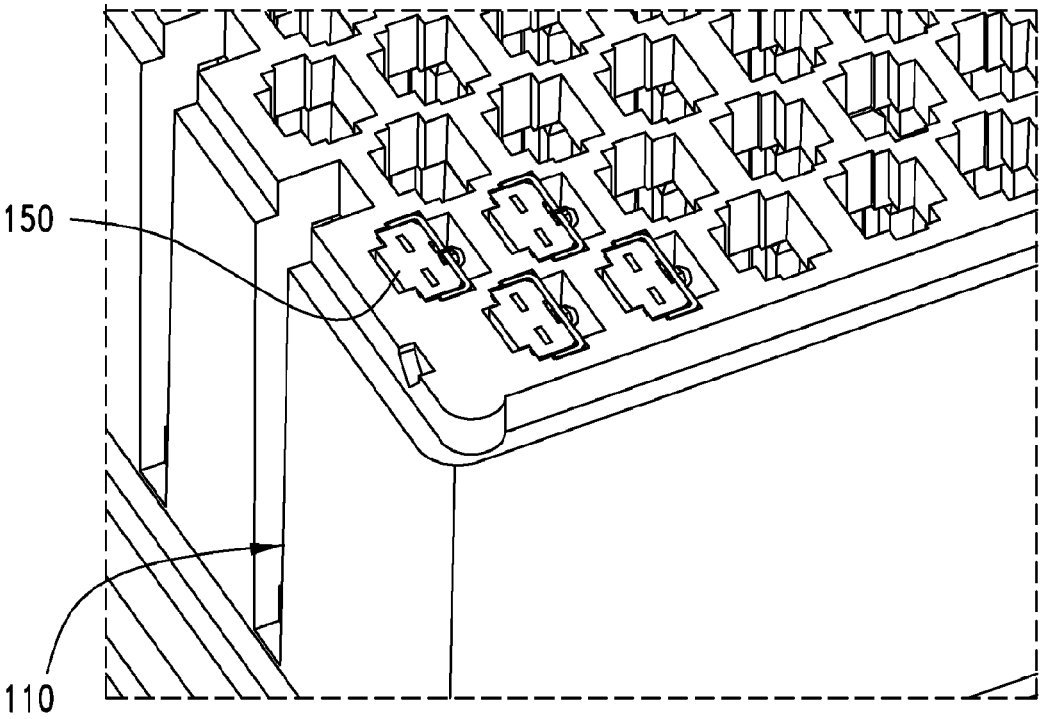
FIG. 3 illustrates a perspective view of a cross-section of an embodiment of a connector system.
Figure 4:
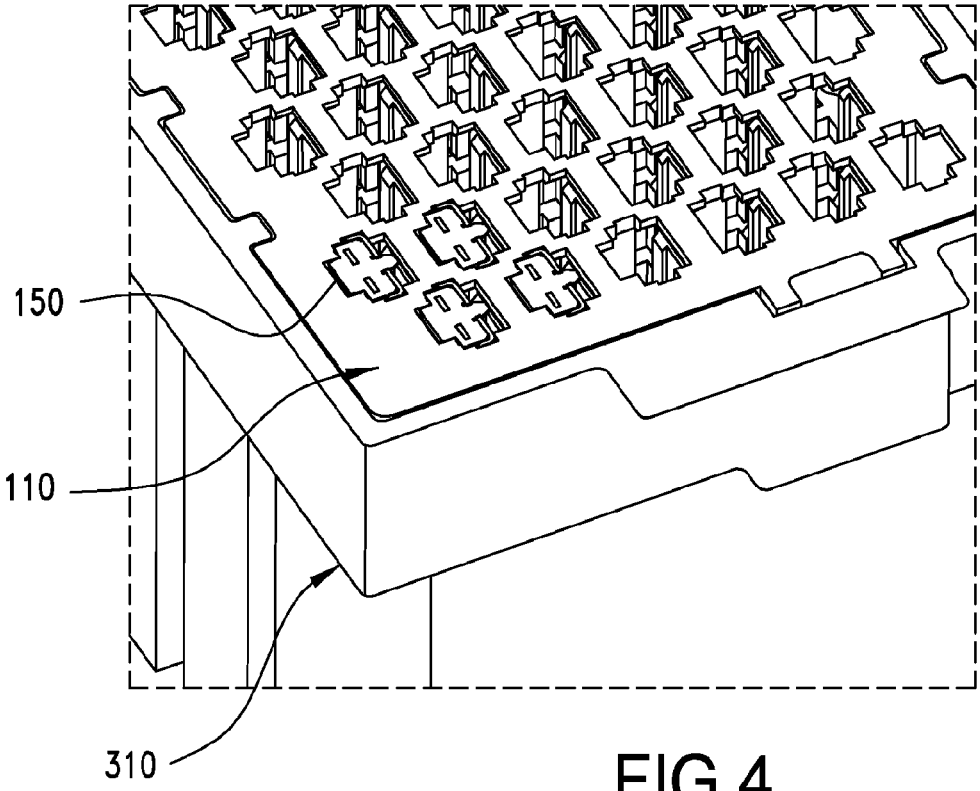
FIG. 4 illustrates a perspective view of another cross-section of the connector system depicted in FIG. 3.
Figure 5:
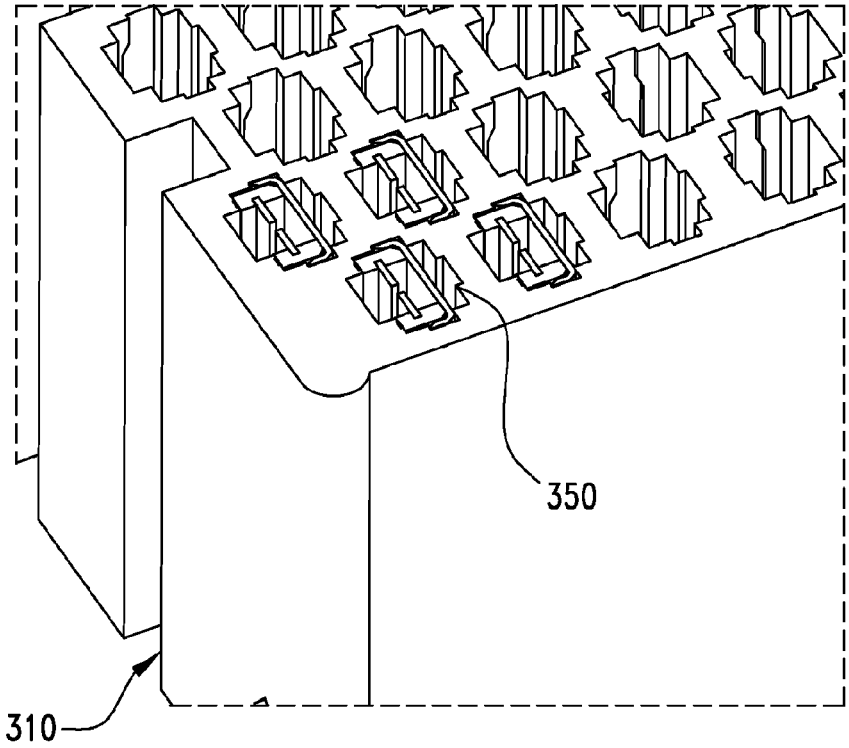
FIG. 5 illustrates a perspective view of a cross-section of an embodiment of a connector system.
Figure 6:
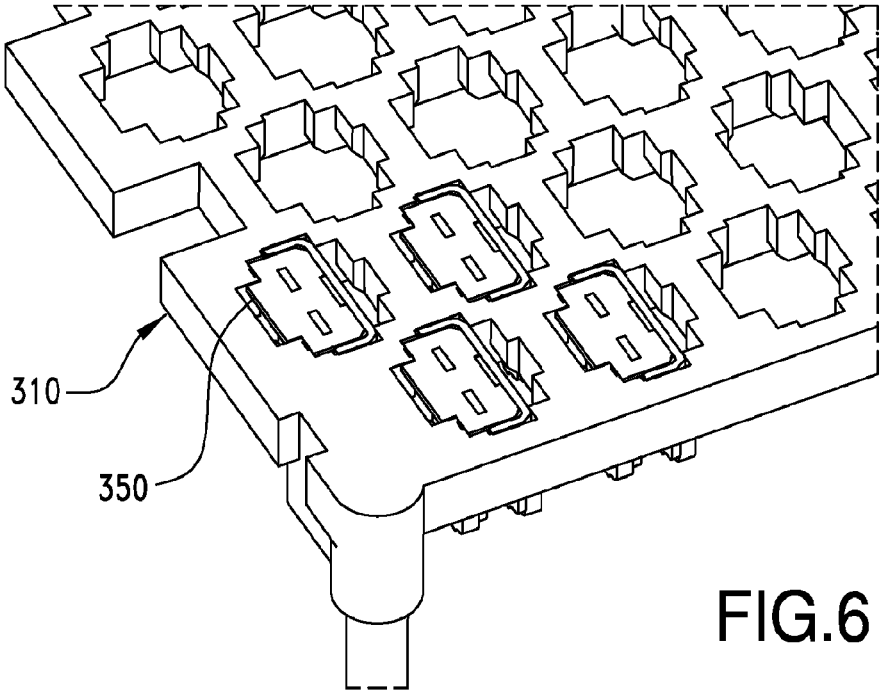
FIG. 6 illustrates a perspective view of a cross-section of an embodiment of a connector system.
Figure 7:
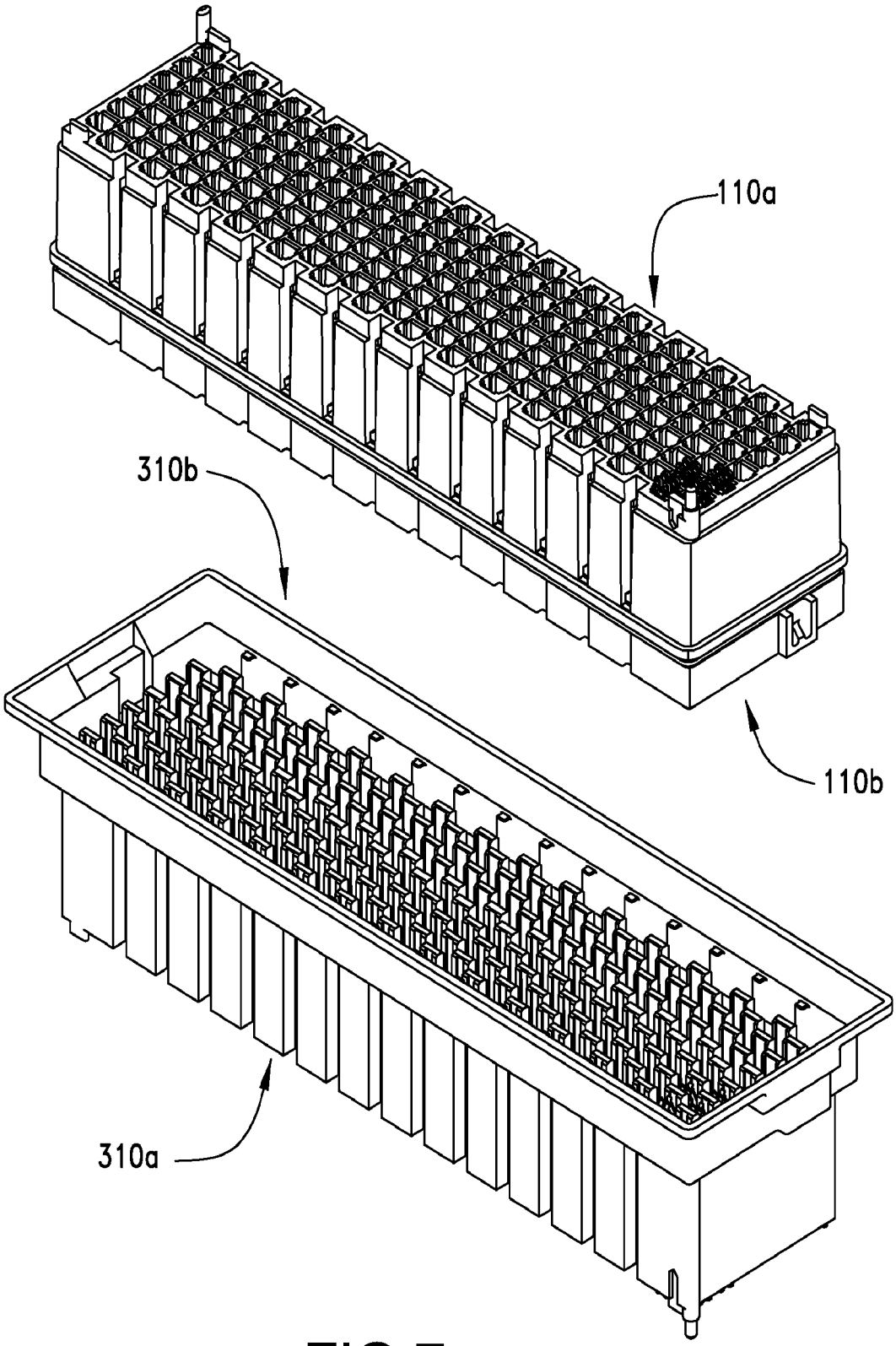
FIG. 7 illustrates a partially exploded perspective view of an embodiment of a connector system.
Figure 8:
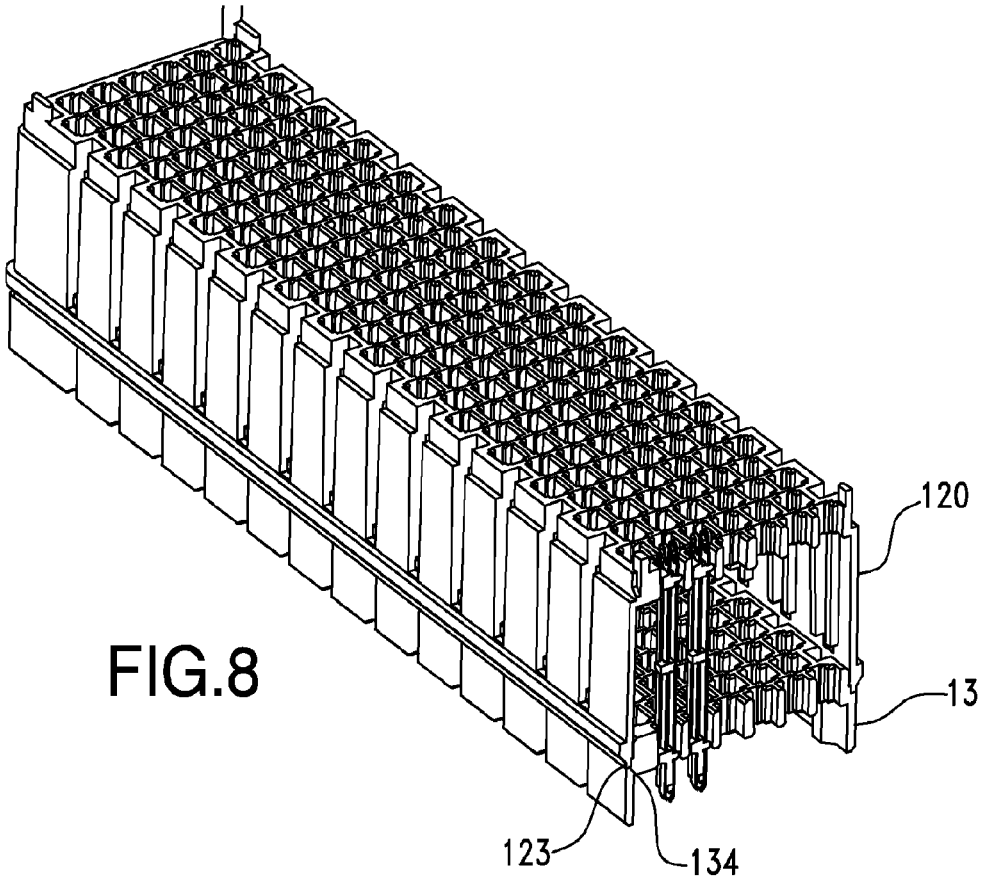
FIG. 8 illustrates a perspective view of a cross-section of an embodiment of a connector.
Figure 9:
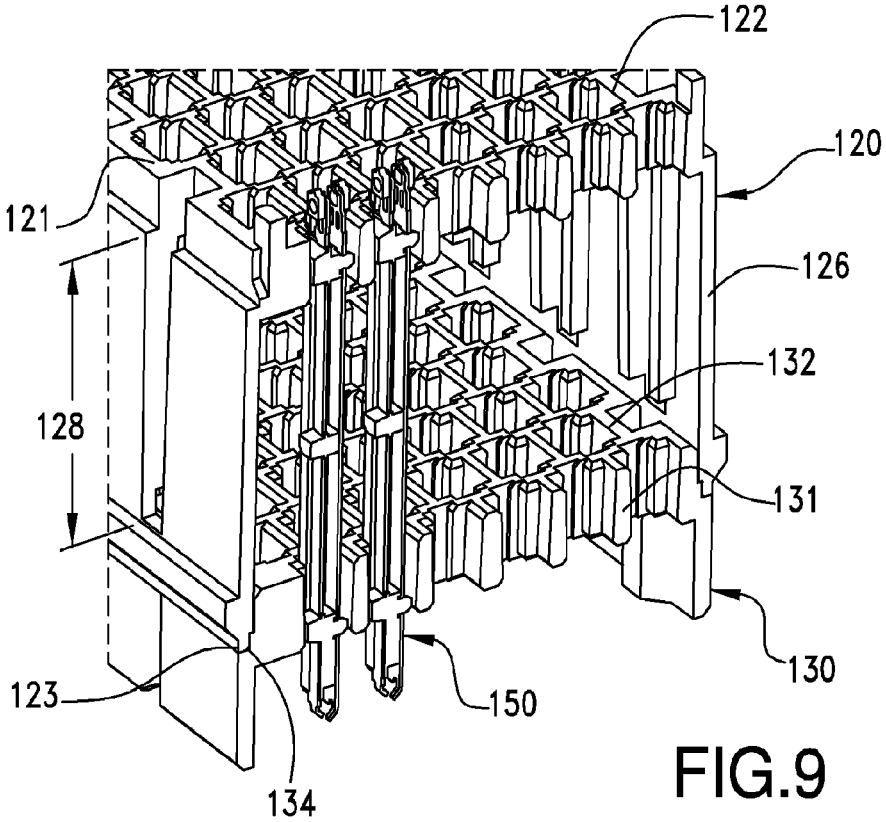
FIG. 9 illustrates an enlarged view of the embodiment depicted in FIG. 8.
Figure 10:
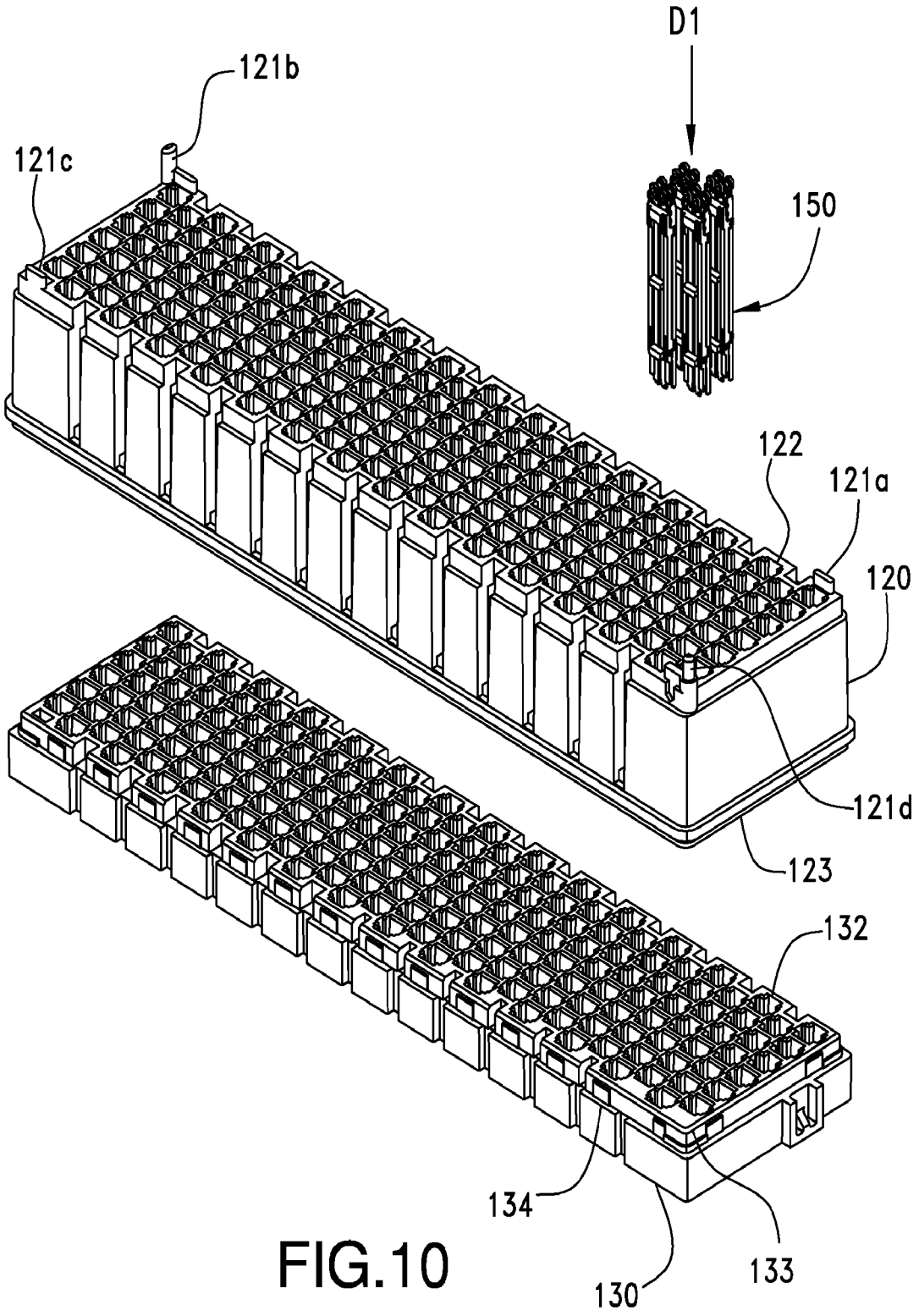
FIG. 10 illustrates a partially exploded perspective view of the embodiment depicted in FIG. 8.
Figure 11:
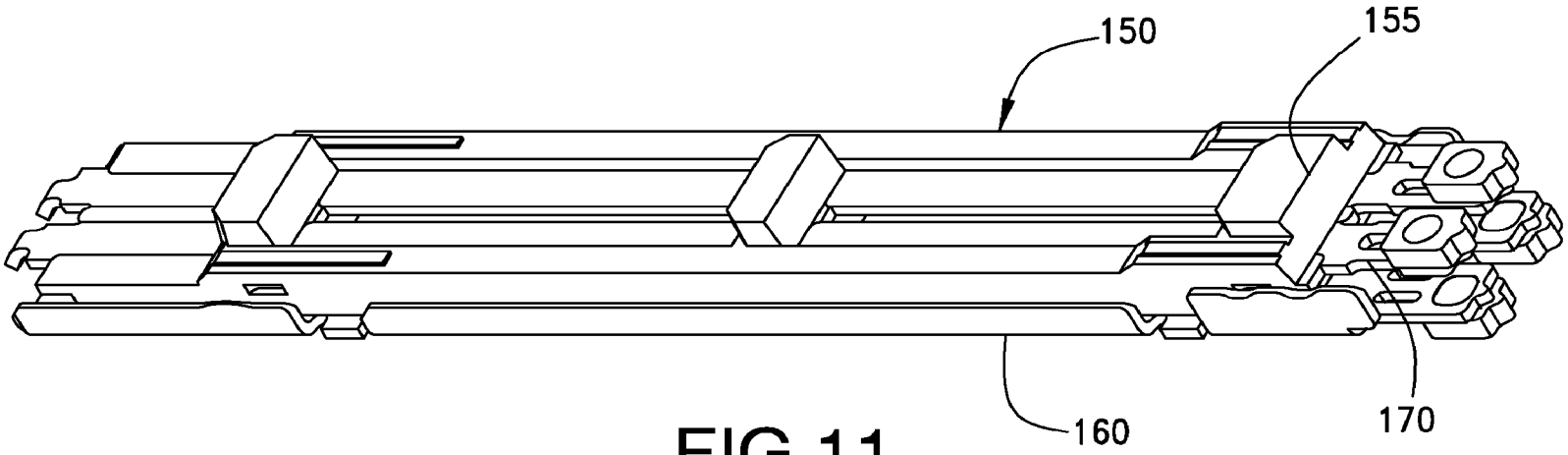
FIG. 11 illustrates a perspective view of an embodiment of a terminal brick.
Figure 12:
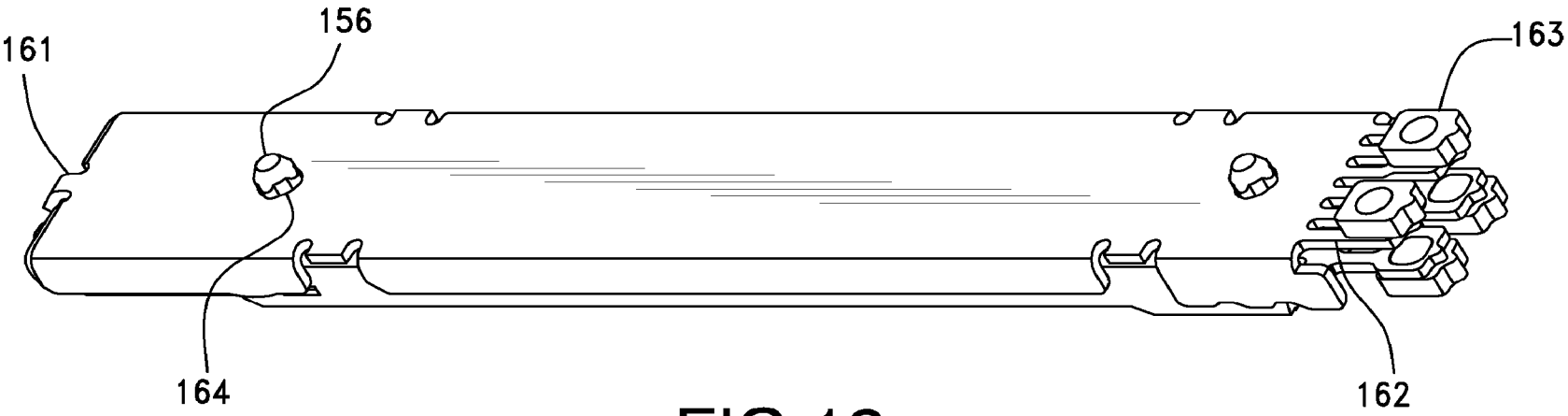
FIG. 12 illustrates another perspective view of the terminal brick depicted in FIG. 11.
Figure 13:
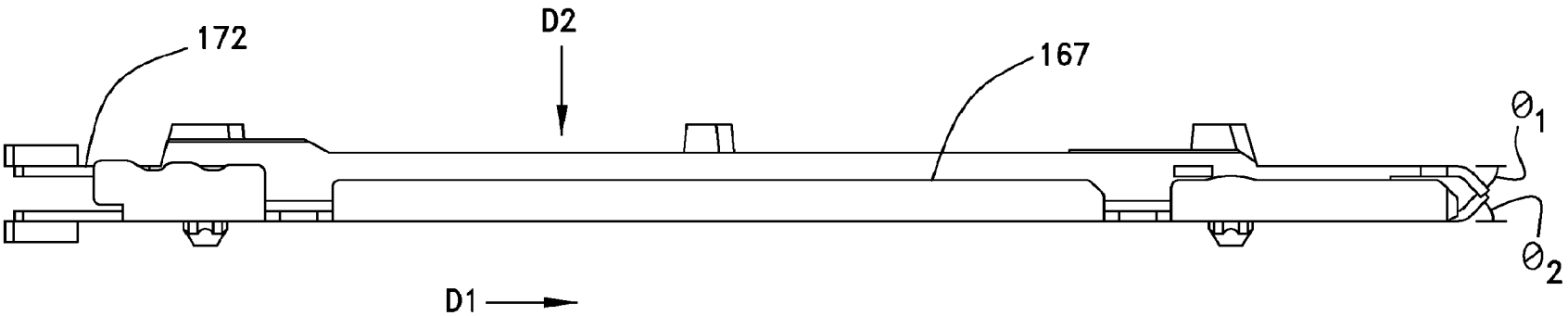
FIG. 13 illustrates an elevated side view of the terminal brick depicted in FIG. 11.
Figure 14:
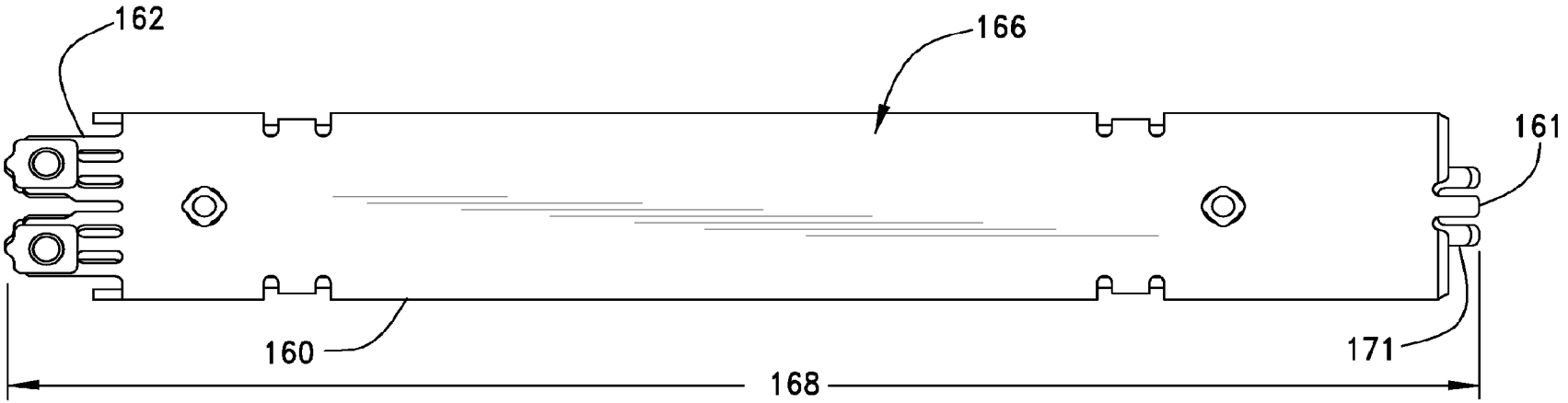
FIG. 14 illustrates a bottom plan view of the terminal brick depicted in FIG. 11.
Figure 15:
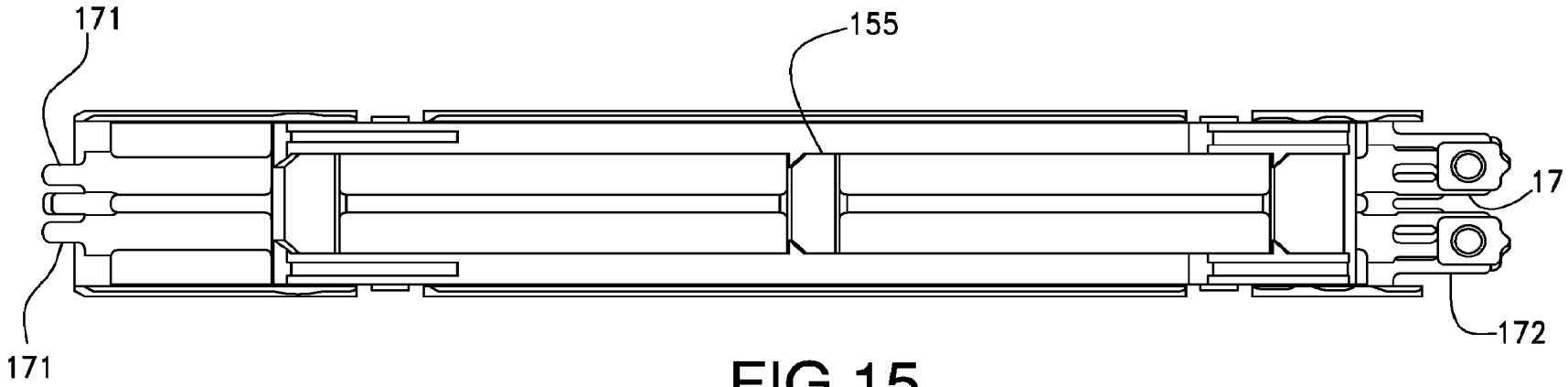
FIG. 15 illustrates a plan view of the terminal brick depicted in FIG. 11.
Figure 16:
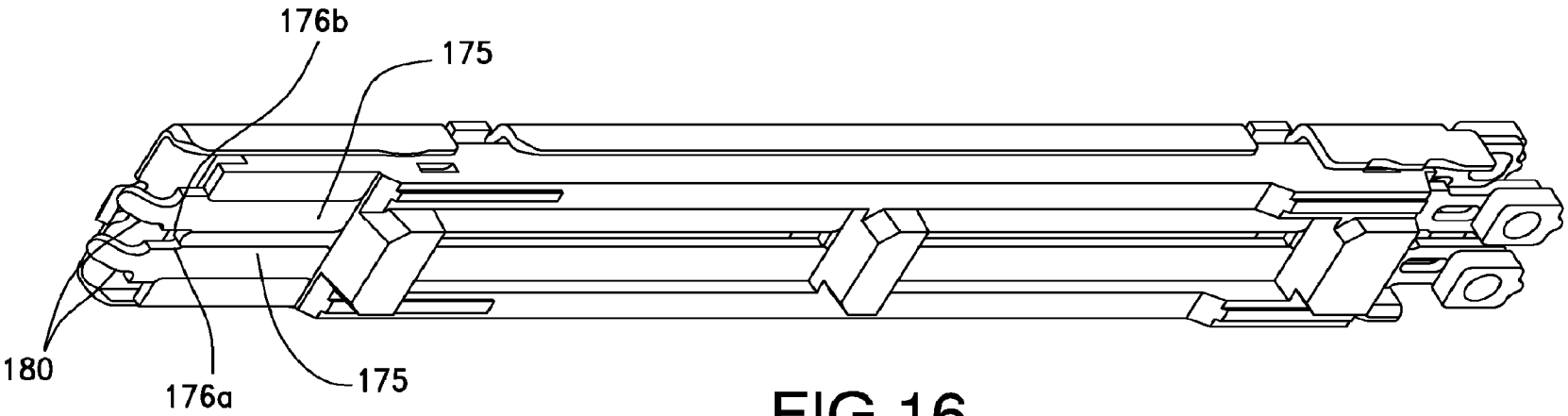
FIG. 16 illustrates another perspective view of the terminal brick depicted in FIG. 11.
Figure 17:
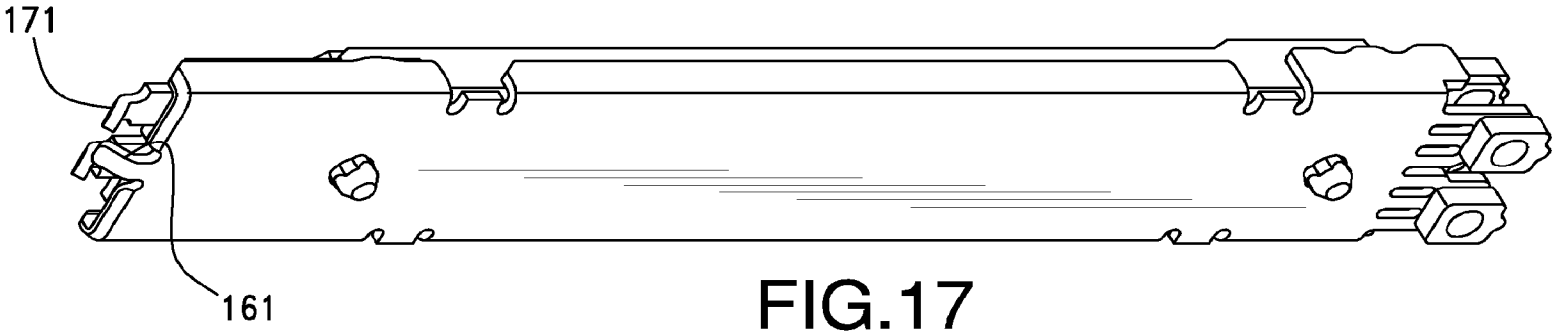
FIG. 17 illustrates another perspective view of the terminal brick depicted in FIG. 11.

As can be appreciated, the apertures 122, 132 together help form a channel 105 that extends through the housing 110 and in an embodiment (such as depicted in FIG. 2) the channel 105 can extend in a substantially straight direction between an mounting surface of a first housings 110 to a mounting surface 310*a* of a second housing 310 when the first housing 110 and the second housing 310 are mated together.

Figure 27:
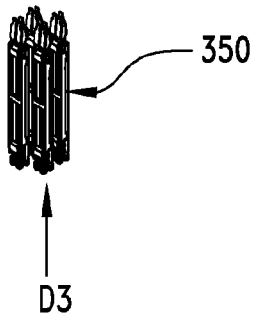
FIG. 27 illustrates a perspective view of a cross-section of an embodiment of a connector.
Figure 27:
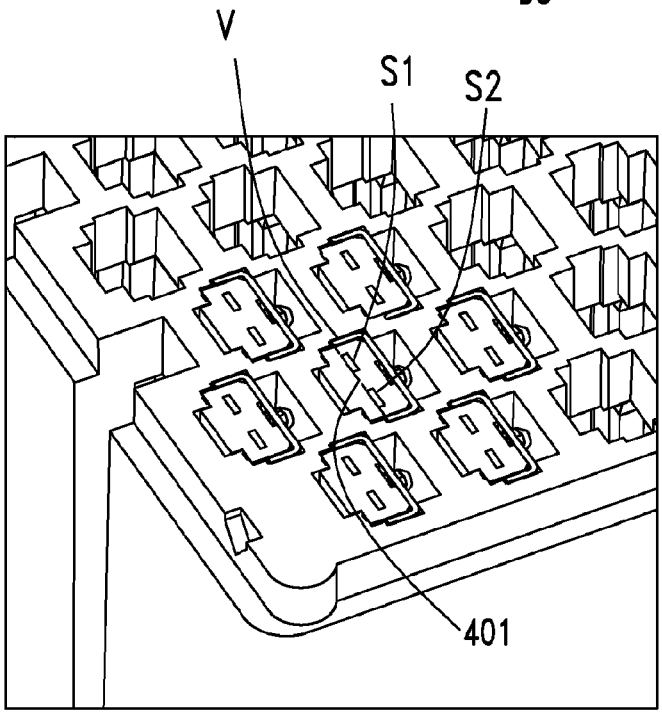
Figure 22:
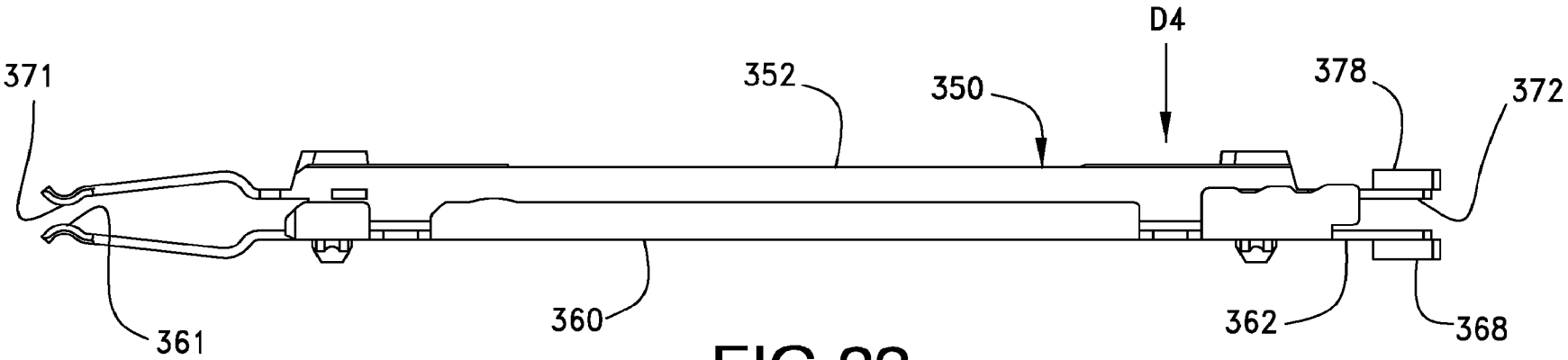
FIG. 22 illustrates a perspective view of an embodiment of a terminal brick.
Figure 23:
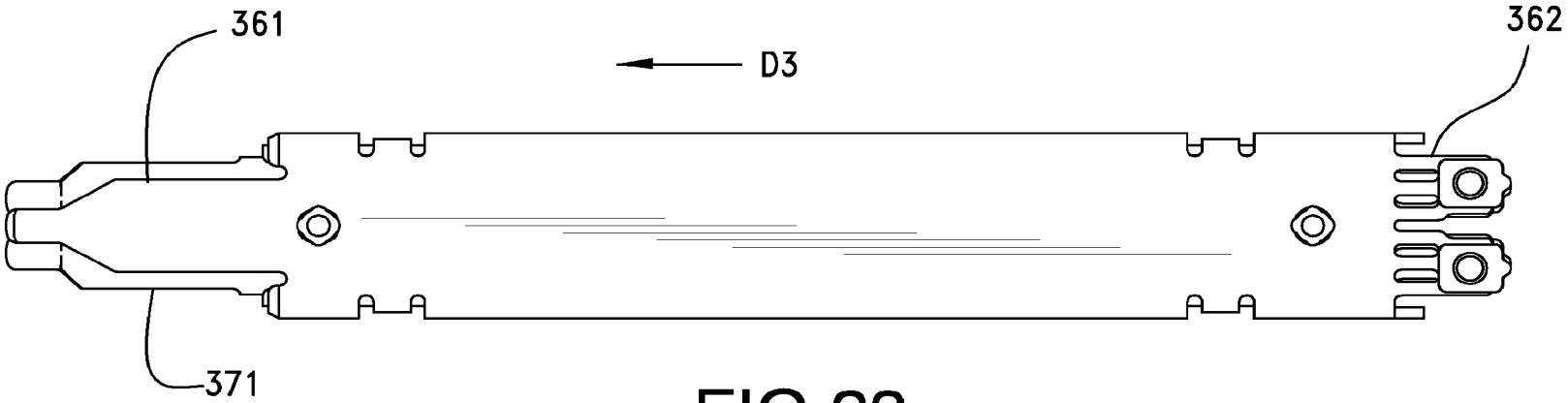
FIG. 23 illustrates a plan view of the terminal brick depicted in FIG. 22.
Figure 24:
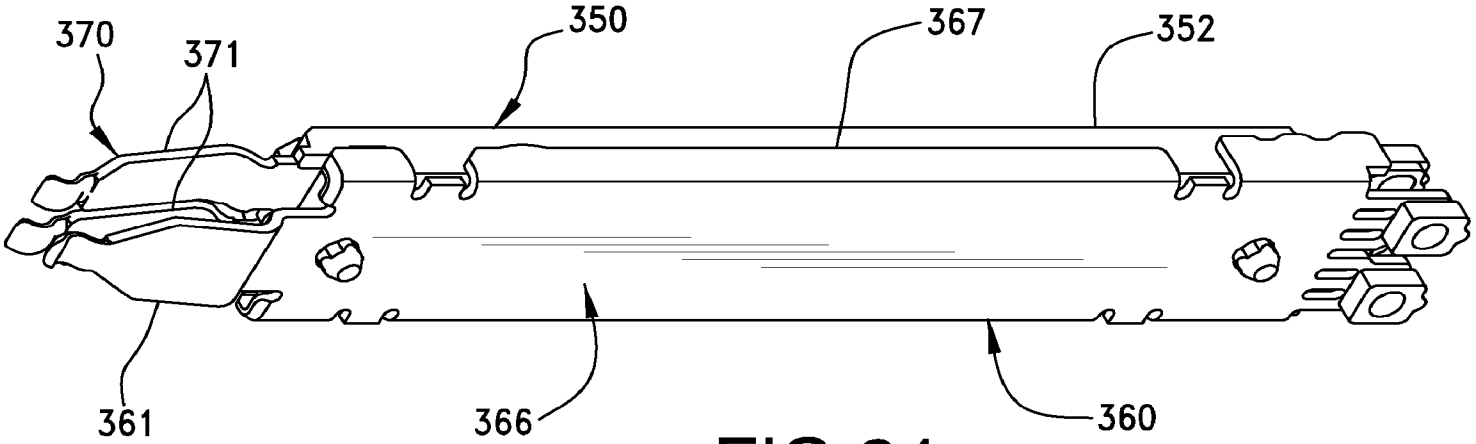
FIG. 24 illustrates another perspective view of the terminal brick depicted in FIG. 22.
Figure 25:
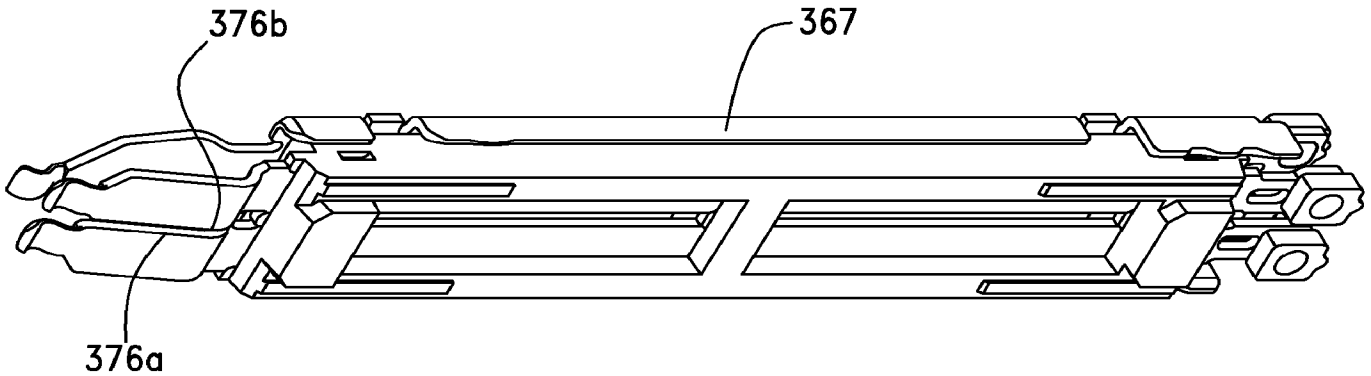
FIG. 25 illustrates another perspective view of the terminal brick depicted in FIG. 22.
Figure 26:
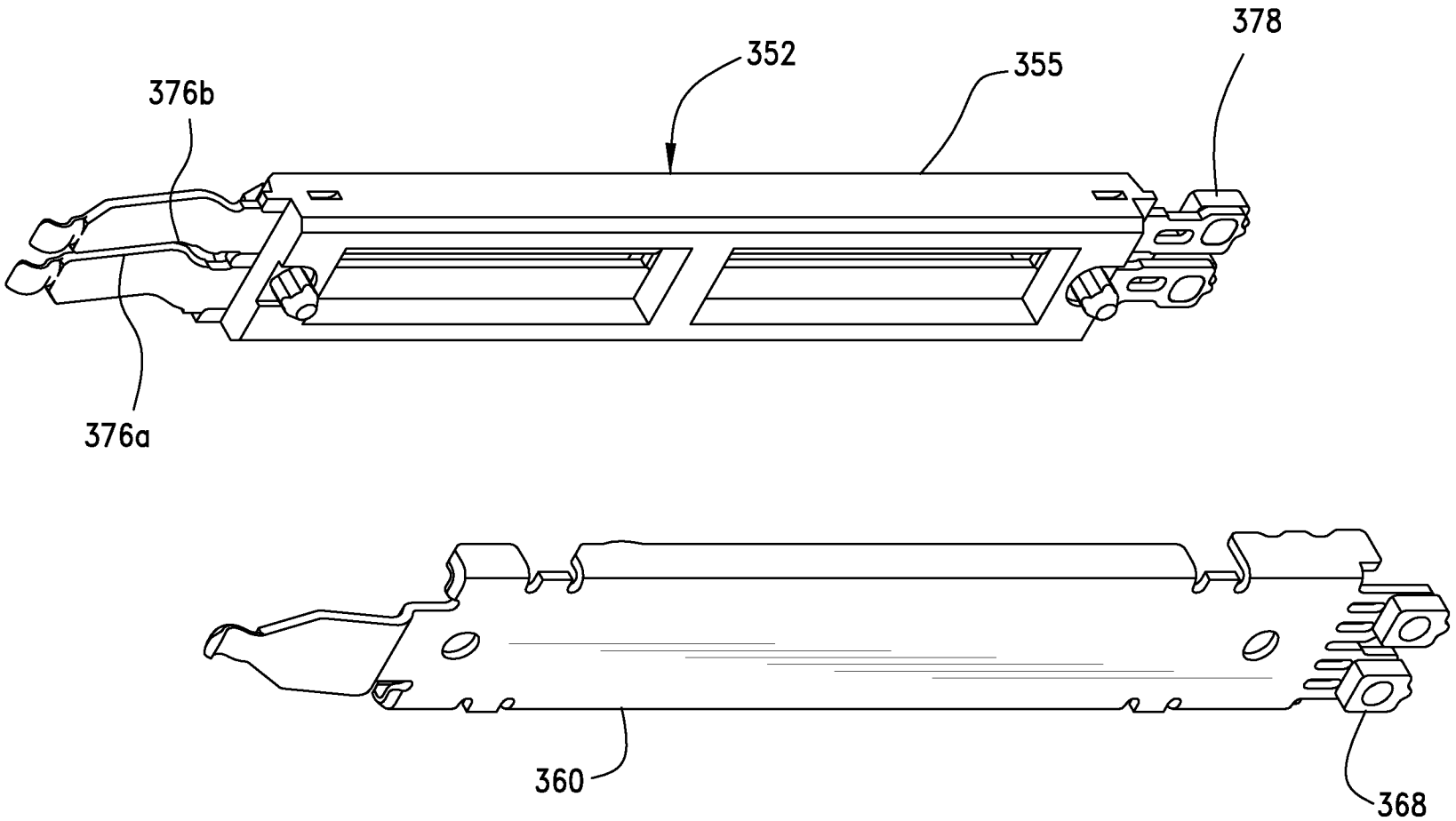
FIG. 26 illustrates a partially exploded perspective view of the terminal brick depicted in FIG. 22.
Figure 28:
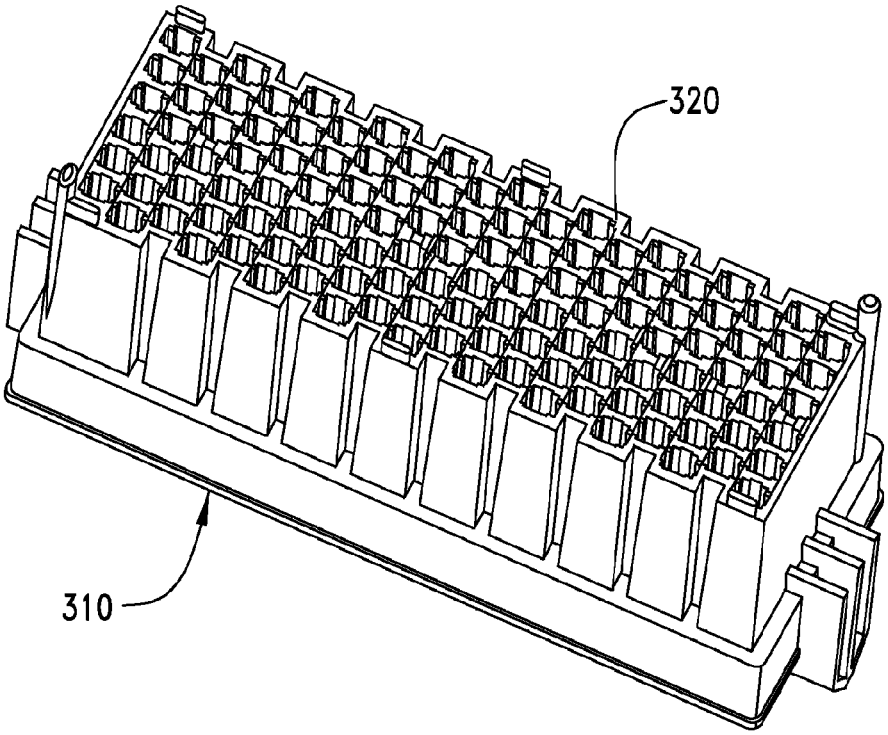
FIG. 28 illustrates a perspective view of an embodiment of a connector housing.
Figure 29:
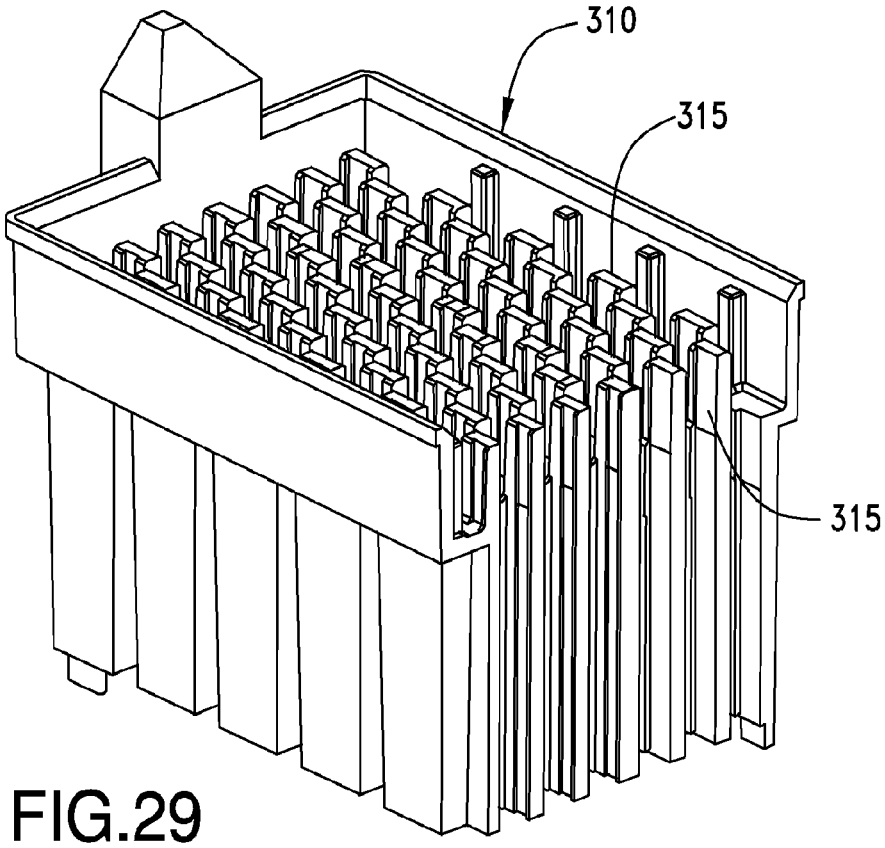
FIG. 29 illustrates another perspective view of a cross-section of the connector housing depicted in FIG. 28.
Figure 30:
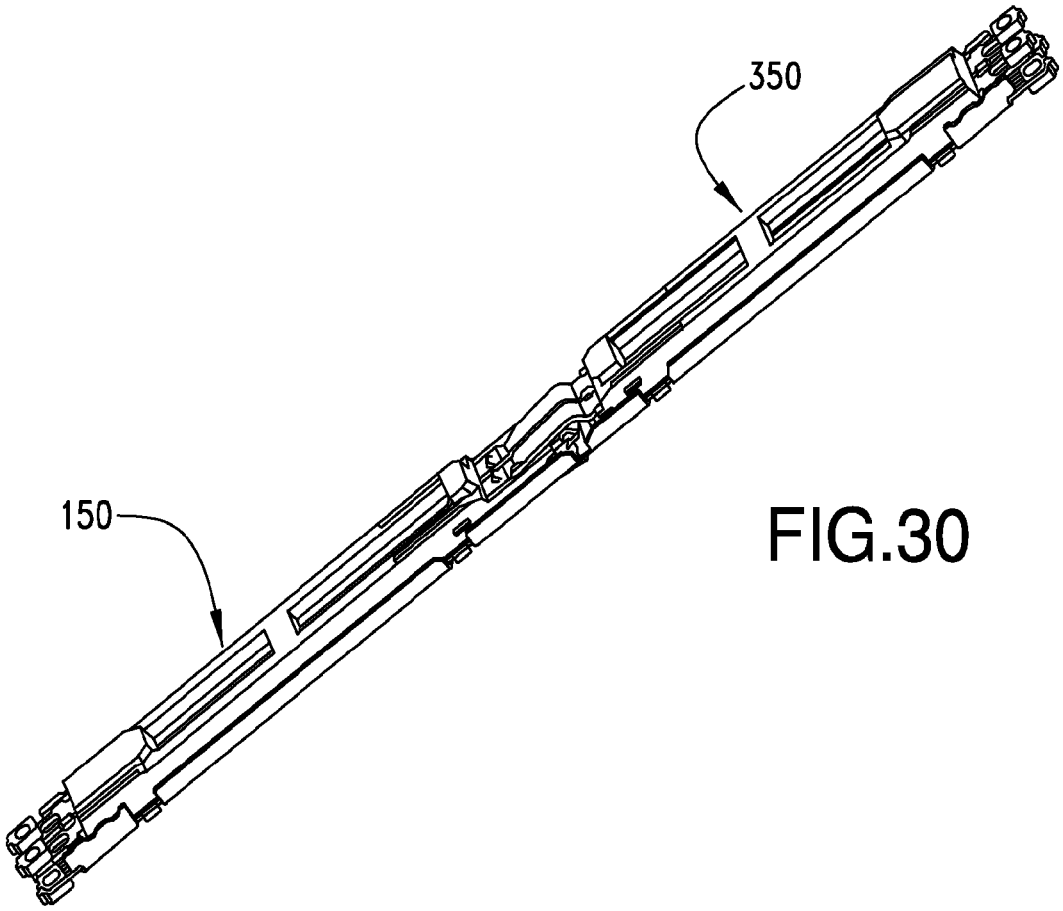
FIG. 30 illustrates a perspective view of a mated pair of terminal bricks.

One significant benefit of the depicted design is that the performance of the terminal brick 150 can be predetermined based on the structure of the terminal brick 150. As depicted, the terminal brick 150 comprises a pod 152 and a ground terminal 160. The pod 152 includes a frame 155 formed around a pair of signal terminals 170 and the terminal brick 150 provides a communication channel with the ground terminal 160 forming a imaginary line 401 that essentially isolates a differential pair 180 formed by the signal terminals 170 (as can be appreciated by FIG. 27). Thus, in an array of terminals, a victim terminal brick V can provide good electrical separation for the signal terminals S1, S2 from the surrounding signal terminals.

The terminals (both the signal terminals and the ground terminal) can include a solder mass 163 provided on tails 162, 172 that is configured to be used to solder the terminals to a corresponding pad on a circuit board. Alternatively, the tails could be configured for press-fit mating to a circuit board. One advantage of the solder attach construction is that the supporting circuit board will not have to include vias, thus the route-out configuration of the circuit board may be simplified.

The ground terminal 160 includes a contact 161 that has an engagement angle $\square_2$ while the signal terminals each have a contact 171 that has an engagement angle $\square_1$. The two engagement angles can be substantially opposite and as can be appreciated, one benefit of the depicted design is that the terminal brick 150 can readily engage mating contacts without stubbing. This provides the benefit of providing a configuration where the terminals don't just engage mating contacts on the same side but instead provide for a configuration where the forces exerted during the mating process can be substantially balanced. Thus, the depicted embodiment potentially reduces the stress placed on the housing 120, 130 during a mating with an opposing connector. This can help reduce the stress on the tails and may provide greater assurance that the connector stays reliably mounted on a circuit board.

As depicted, the ground terminal 160 includes two tails that are aligned with the tails 172 of the signal terminals. Typically the mating and/or mounting interface of a connector changes the impedance of the terminals due to the change in structure that is necessary at the interface. By have two tails 162 of the ground terminal 160 aligned with the signal terminals and extending to the supporting circuit board, the impedance of the differential terminals can be kept closer to the desired value (which may change depending on the application) over their entire length. This design, as can be appreciated, thus helps provide consistent impedance all the way to the board (and helps provides less of a change in the impedance in the mounting interface) and also helps shield the signal terminals from the signal terminals of adjacent terminal bricks.

In an embodiment, the frame 155 includes blocks that are spaced apart and provide additional structure to support the signal terminals 170. To improve performance, the signal terminals 170 can include displaced portions 175 that are aligned with each other but offset from the ground terminal 160. While the width of the terminal is maintained in the displaced portion, a neck-down portion 176*a*, 176*b* decreases the amount of metal used to provide the signal terminal. A bent portion 180 provides the contacts 171 that engage mating terminals on a mating connector. As can be appreciated, because the contacts 171 of the signal terminals 170 are bent toward the contacts 161 of the ground terminal it has been determined to be undesirable to have two contacts on the ground terminal side. Instead, the contact 161 and signal contacts 171 are angled so as to transition toward a more in-line relationship (which may or may not be fully in line) and thus can provide what is substantially a signal/ground/signal orientation before transitioning back to a edge-coupled signal-signal pair at least partially enclosed in a U-shaped ground terminal (as is provided by the terminal brick 150/350).

Figure 18:
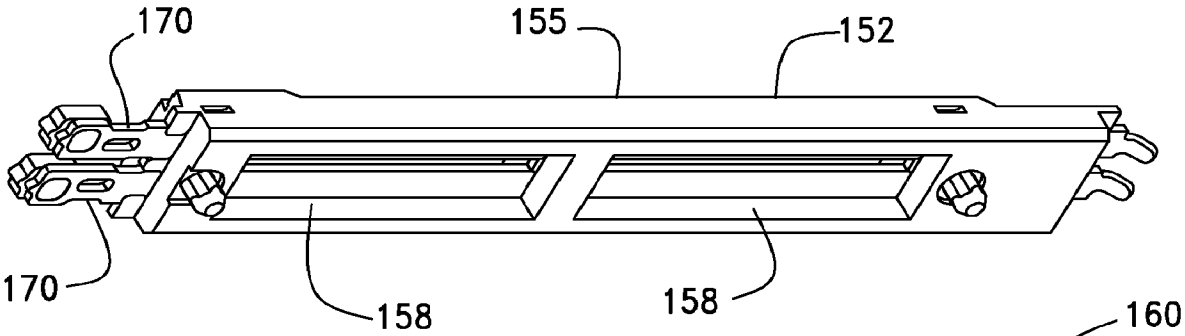
FIG. 18 illustrates a partially exploded perspective view of an embodiment of a terminal brick.
Figure 18:
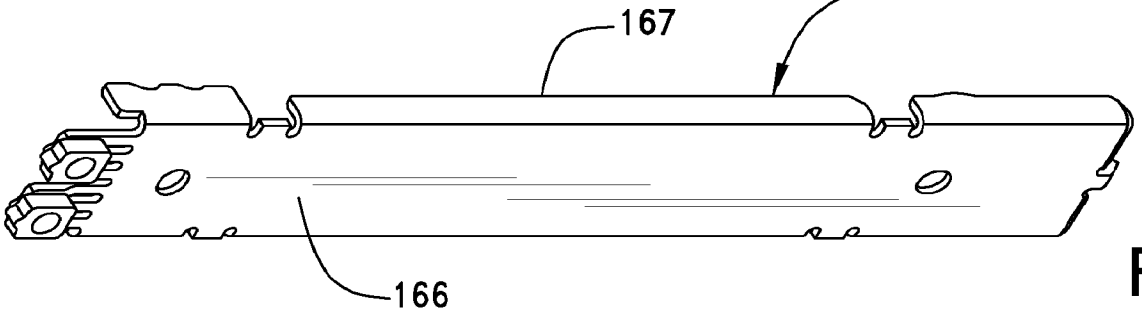
Figure 19:
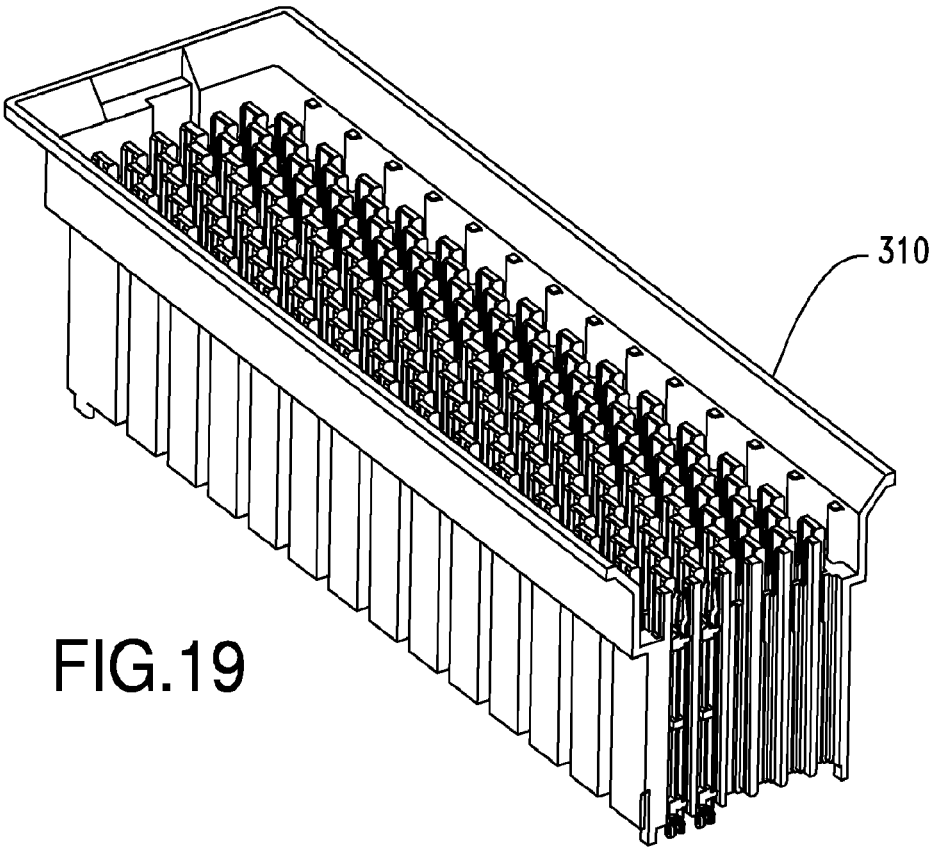
FIG. 19 illustrates a perspective view of a cross-section of an embodiment of a connector.
Figure 20:
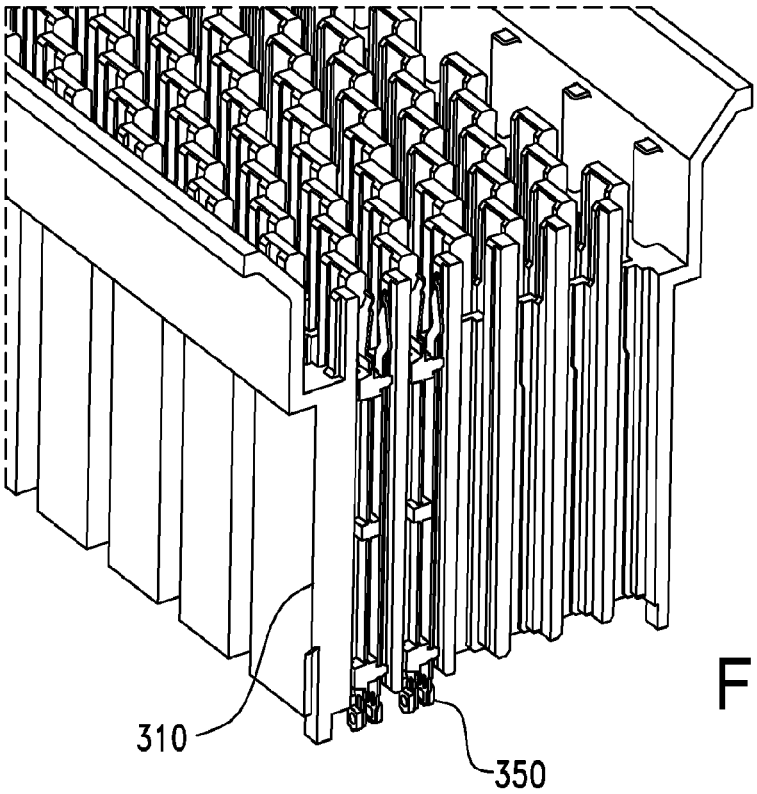
FIG. 20 illustrates an enlarged perspective view of the embodiment depicted in FIG. 19.
Figure 21:
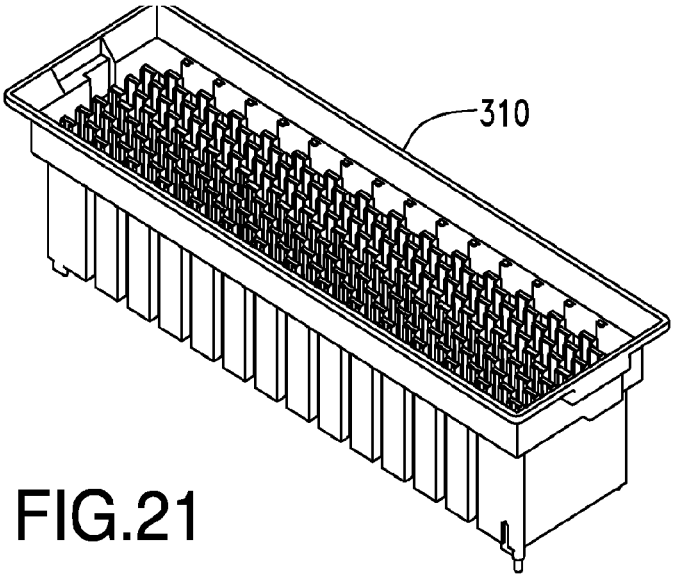
FIG. 21 illustrates a partially exploded perspective view of an embodiment of a connector.

As can be appreciated from FIG. 18, the frame 155 can include one or more windows 158 that are aligned with the signal terminals. As can be appreciated, this has a tendency to lower the dielectric constant associated with the signal terminals and be used to tune the signal terminals so that the electrical length of the signal terminals and the ground terminals is substantially uniform while helping to provide a consistent impedance through the length of the terminal brick. It should be noted that two windows are disclosed but a single window or a greater number of windows could also be used (it being understood that using one window might reduce the strength of the terminal brick while using multiple windows might increase the associated dielectric constant).

As can be appreciated, the terminal brick 150 is inserted in a first direction D1 into a corresponding channel provided by the housing 110. The pod 152, however, is mated with the U-shaped ground terminal 160 by translation in a second direction D2 which is substantially perpendicular to the first direction D1. This helps insure the pod 152 is less likely to be dislodged from the ground terminal 160 during installation of the terminal brick 150 into the housing 110. The pod can include multiple fingers 156 that have a snap-fit with a corresponding aperture 164 in the ground terminal 160.

The connector 100 mates with the connector 300 and connector 300 includes a housing 310 that supports terminal bricks 350 and includes a mounting face 310*a* and a mating face 310*b*. In should be noted the features of the mating face 110*b* and 310*b* have a polarity that could be reversed if desired (e.g., the connector 110 could have a lip that extends around it perimeter and is configured to receive connector 310). The housing 310 includes posts 315 that extend from a floor 320 and the posts define channels that support the terminal bricks 350.

The terminal brick 350 includes a pod 352 that supports signal terminals 370 with a frame 355. The pod 352 can be mounted on a ground terminal 360 by translating the pod 352 (which can be accomplished by relative movement of the pod 352 and the ground terminal 360) in a fourth direction D4. Then the resultant terminal brick 350 can then be inserted in to the housing 310 by translation in a third direction D3, where direction D3 and D4 can be substantially perpendicular to each other.

It should be noted that the terminal brick 350 can have a similar construction to terminal brick 150 (discussed above). For example, the signal terminals 370 each include a contact 371 and a tail 372 that can support a solder mass 378. The ground terminal 360 includes a base 366 with sides 367 that, in combination form a U-shaped channel. The ground terminal 360 further includes a contact 361 and two tails 362 that can each support a solder mass 368.

It should be noted that the contacts 371 are supported by arms that have opposing edges 376*a*/376*b* and the spacing between the edges 376*a*/376*b* can be adjusted to control differential impedance in the mating interface. Thus, a communication channel can be provided that includes a terminal brick 150 coupled to a terminal brick 350. The length of one of the terminal bricks (and the respective housing) can be adjusted distinct from the other so as to provide for a connector system that can support a number of different spacing requirements with a minimal number of designs.

Figure 31:
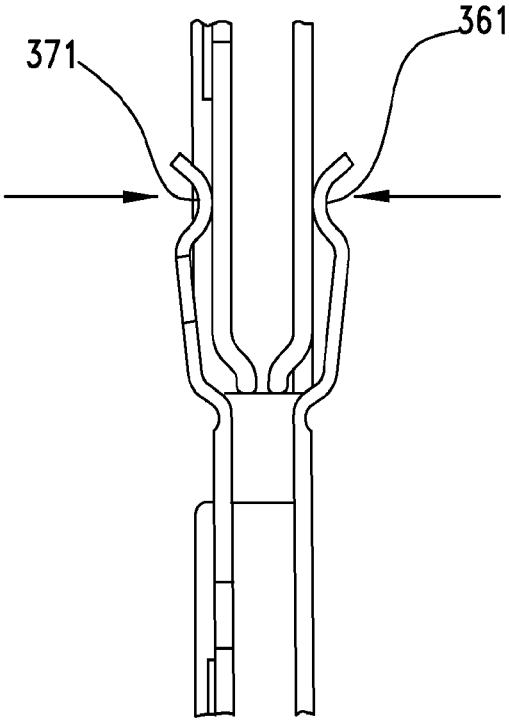
FIG. 31 illustrates an enlarged elevated side view of a cross-section of a pair of mated terminal bricks.

As can be appreciated from FIG. 31, the contacts 371 and contact 361 are configured to deflect in the opposite direction when mating to the contacts 161, 171. This helps reduce stresses on the terminal brick and the resultant housing when the connector 300 mates with the connector 100 and can also help reduce the forces exerted on the solder joints of the terminals.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. A connector, comprising:

a housing having a first mounting face and a first mating face positioned on opposite sides of the housing, the housing having a channel extending from the mounting face to the mating face; and a terminal brick positioned in the channel, the terminal brick including a pod and a U-shaped ground terminal, the pod comprising a pair of signal terminals positioned in a frame, each signal terminal having a contact, a tail and a body extending between the tail, the signal terminals aligned so as to provide edge-to-edge coupling, wherein the terminal brick is configured to be inserted into the channel in a first direction that extends between the tail and the contact of the signal terminal and the pod is configured to be inserted into the U-shaped ground terminal in a direction that is transverse to the first direction.

2. The connector of claim 1, wherein the frame is insert-molded to the signal terminals.

3. The connector of claim 1, wherein the pod has a length that extends a first distance from a first end of the signal terminal adjacent the tail to a second end of the signal terminal adjacent the contact and the channel has a width extending a second distance from two opposing side walls, the first distance being at least four times greater than the second distance.

4. The connector of claim 1, wherein the U-shaped ground terminal includes a base with a first and second side that extend from the base, the first and second side each having an edge, wherein the edges defining a plane, and wherein the signal terminals are at least partially positioned between the plane and the base.

5. The connector of claim 1, wherein the pod includes at least one window, the at least one window extending along a length of the signal terminal body.

6. The connector of claim 5, wherein the at least one window extends along a majority of the length of the signal terminal body.

7. The connector of claim 1, wherein the ground contact and the signal contacts are facing opposing directions.

8. The connector of claim 7, wherein the ground contact is configured to deflect in a first direction away from signal contacts and the signal contacts are configured to deflect in a second direction away from the ground contact.

9. The connector of claim 1, wherein the ground terminal includes two tails.

10. The connector of claim 9, wherein the two tails of the ground terminal are aligned with the tails of the signal terminals.

11. A connector system, comprising:

a first housing having a first mounting face and a first mating face positioned on opposite sides of the first housing, the first housing including a first channel extending from the first mounting face to the first mating face, the mounting face configured to be positioned on a circuit board;

a second housing having a second mounting face and a second mating face positioned on opposite sides of the second housing, the second housing including a second channel extending from the second mounting face to the second mating face;

a first terminal brick positioned in the first channel, the first terminal brick including a first pod and a first U-shaped ground terminal, the first pod comprising a pair of signal terminals positioned in a frame, each signal terminal having a contact, a tail and a body extending between the tail, the signal terminals aligned so as to provide edge-to-edge coupling and the tails of the signal terminals positioned adjacent the mounting face and configured to be soldered to circuit board; and a second terminal brick positioned in the second channel, the second terminal brick including a second pod and a second U-shaped ground terminal, the second pod comprising a pair of signal terminals positioned in a frame, each signal terminal of the pair of signal terminals having a contact, a tail and a body extending between the tail, the pair of signal terminals aligned so as to provide edge-to-edge coupling; wherein the contacts of the first terminal brick are configured to mate with the contacts of the second terminal brick.

12. The connector system of claim 11, wherein the first and second pod are both insert-molded to the corresponding pair of signal terminals.

13. The connector system of claim 11, wherein the first housing is formed of two sections coupled together, the two sections each including an aperture that defines the first channel.

14. The connector system of claim 11, wherein at least two contacts of the second terminal brick are deflected in opposite directions by the contacts of the first terminal brick.

* * * * *